US007172483B2

(12) United States Patent
Ando et al.

(10) Patent No.: US 7,172,483 B2
(45) Date of Patent: Feb. 6, 2007

(54) METHOD OF MAKING METALLIC SHELL FOR SPARK PLUG, METHOD OF MAKING SPARK PLUG HAVING METALLIC SHELL AND SPARK PLUG PRODUCED BY THE SAME

(75) Inventors: Minoru Ando, Nagoya (JP); Takaaki Mizoguchi, Nagoya (JP); Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 60 days.

(21) Appl. No.: 10/759,281

(22) Filed: Jan. 20, 2004

(65) Prior Publication Data

US 2004/0145290 A1 Jul. 29, 2004

(30) Foreign Application Priority Data

Jan. 21, 2003 (JP) ..... 2003-012763

(51) Int. Cl.
*F02M 57/06* (2006.01)
*H01T 21/02* (2006.01)
*H01T 13/54* (2006.01)
*B21D 22/00* (2006.01)

(52) U.S. Cl. ..... 445/7; 313/118; 72/356; 123/169 R

(58) Field of Classification Search ..... 445/7; 123/169 R; 313/118; 72/356
See application file for complete search history.

(56) References Cited

U.S. PATENT DOCUMENTS 1,701,401 A * 2/1929 Blackmore ..... 445/7
1,726,264 A * 8/1929 Hamilton ..... 445/7
3,186,209 A * 6/1965 Friedman ..... 313/143
4,520,521 A * 6/1985 Miyake ..... 470/21
5,088,311 A * 2/1992 Inoue ..... 72/333
2003/0196468 A1 * 10/2003 Ando et al. ..... 72/353.2

FOREIGN PATENT DOCUMENTS

CA 645083 * 7/1962 ..... 72/354.6
JP 07-016693 A 1/1995
JP 08285280 A * 11/1996

(Continued)

OTHER PUBLICATIONS

Computer translation of Kiyoshi taken from http://www19.ipdl.ncipi.go.jp/PA1/cgi-bin/PA1DETAIL on Apr. 28, 2006.*
European Search Report for EP 04 25 0241 dated Apr. 22, 2004.

*Primary Examiner*—Nimeshkumar D. Patel
*Assistant Examiner*—Peter Macchiarolo
(74) *Attorney, Agent, or Firm*—Sughrue Mion, PLLC

(57) ABSTRACT

A method of making a metallic shell for a spark plug. The metallic shell includes a multi-stepped through hole, an intermediate tubular portion, a tip end side tubular portion and a base end side tubular portion. The through hole includes a large diameter hole section, an intermediate diameter hole section and a small diameter hole section. The method includes the steps of cutting a metal pipe that is used as a starting material to a predetermined length and thereby preparing a pipe-shaped blank, and subjecting the blank to a deformation process and thereby forming the blank into the metallic shell. A spark plug and a method of making the same are also disclosed.

8 Claims, 5 Drawing Sheets

FOREIGN PATENT DOCUMENTS

| | | |
|---|---|---|
| CH | 317554 | 11/1956 |
| DE | 101 28 397 A1 | 12/2002 |
| JP | 61-066018 A | 4/1986 |
| JP | 04-236010 A | 8/1992 |

* cited by examiner

METHOD OF MAKING METALLIC SHELL FOR SPARK PLUG, METHOD OF MAKING SPARK PLUG HAVING METALLIC SHELL AND SPARK PLUG PRODUCED BY THE SAME

BACKGROUD OF THE INVENTION

The present invention relates to a method of making a metallic shell for a spark plug. Further, the present invention relates to a method of making a spark plug having a metallic shell and a spark plug produced by the same.

A spark plug serves as a spark discharging means in an ignition system and includes a tubular metallic shell. The metallic shell is so shaped as to have a stepped, concentric through hole including, in the order from a basic end side to a tip end side thereof, a large diameter hole section, an intermediate diameter hole section smaller in diameter than the large diameter hole section and a small diameter hole section smaller in diameter than the intermediate hole section. In the meantime, the term "tip end side" is herein used to indicate the side where a spark discharging section of a spark plug is located. The above-described metallic shell is formed from a solid round metal bar that is cut to a predetermined length, by a suitable combination of extrusion or cold forging processes, piercing processes, etc. as disclosed in Unexamined Japanese Patent Publication No. 7-16693.

SUMMARY OF THE INVENTION

In these years, the space occupied by intake and exhaust valves within a combustion chamber has increased with an increasing demand for a higher output of an automotive engine. For this reason, a spark plug for igniting an air-fuel mixture is required to be more compact in size. Furthermore, the temperature inside the combustion chamber tends to become higher, so that sufficient radiation of heat at the electrode section is necessitated in order to attain a sufficient life of the spark plug even under a severe condition of usage. For this reason, it has been tried to improve the heat radiating property of the spark plug by making longer the tip end side tubular portion of the metallic shell, i.e., by means of so-call long reach. To meet with such a demand for a small-size and long reach, the multi-stepped hole (having the large diameter hole section, intermediate diameter hole section and small diameter hole section) of the metallic shell is required to be smaller in diameter and longer in length. The method of the above-described Japanese Patent Publication has a possibility of being encountered by a problem that tools such as piercing punches necessary for forming the multi-stepped hole are subjected to large loads and therefore quite short in life and a problem that there is a difficulty in attaining a desired straightness of the multi-stepped hole.

It is accordingly an object of the present invention to provide a method of making a metallic shell of a spark plug which enables tools used in the method to be longer in life and enables the metallic shell to be made with a high accuracy and at low cost.

It is a further object of the present invention to provide a method of making a spark plug having a metallic shell of the foregoing character.

It is a further object of the present invention to provide a spark plug that is made by the method of the foregoing character.

To achieve the above object, there is provided according to an aspect of the present invention a method of making a metallic shell for a spark plug, the metallic shell including a concentric through hole, an intermediate tubular portion, a tip end side tubular portion disposed on a tip end side of the intermediate tubular portion and a base end side tubular portion disposed on a base end side of the intermediate tubular portion, the through hole including, in the order from a base end side to a tip end side, a large diameter hole section, an intermediate diameter hole section smaller in diameter than the large diameter hole section and a small diameter hole section smaller in diameter than the intermediate hole section, the method comprising the steps of cutting a metal pipe that is used as a starting material to a predetermined length and thereby preparing a pipe-shaped blank, and subjecting the blank to a deformation process and thereby forming the blank into the metallic shell.

According to another aspect of the present invention, there is provided a method of making a metallic shell for a spark plug, the metallic shell including a concentric through hole, an intermediate tubular portion, a tip end side tubular portion disposed on a tip end side of the intermediate tubular portion and a base end side tubular portion disposed on a base end side of the intermediate tubular portion, the through hole including, in the order from a base end side to a tip end side, a large diameter hole section, an intermediate diameter hole section smaller in diameter than the large diameter hole section and a small diameter hole section smaller in diameter than the intermediate hole section, the method comprising the steps of cutting a metal pipe that is uses as a starting material to a predetermined length and thereby preparing a pipe-shaped blank, subjecting the blank to a deformation process and thereby forming the blank into the metallic shell, installing an insulator assembly having an insulator in which a center electrode and a terminal member are installed in the metallic shell by inserting the insulator assembly into the metallic shell from the base end side thereof, and joining an end of a ground electrode to a tip end of the metallic shell and making another end side of the ground electrode be disposed opposite to the center electrode.

According to a further aspect of the present invention, there is provided a spark plug comprising an insulator having a multi-stepped through hole, a center electrode disposed in the through hole so as to be positioned at a tip end side thereof, a metallic shell made up of a tubular member having a through hole within which the insulator is disposed, and a ground electrode having an end connected to the metallic shell and the other end portion disposed opposite to the center electrode, wherein the metallic shell is formed from a metal pipe having a predetermined inner diameter, a smallest diameter hole section of the multi-stepped through hole of the metallic shell having a diameter equal to the inner diameter of the pipe.

Figure 1A:
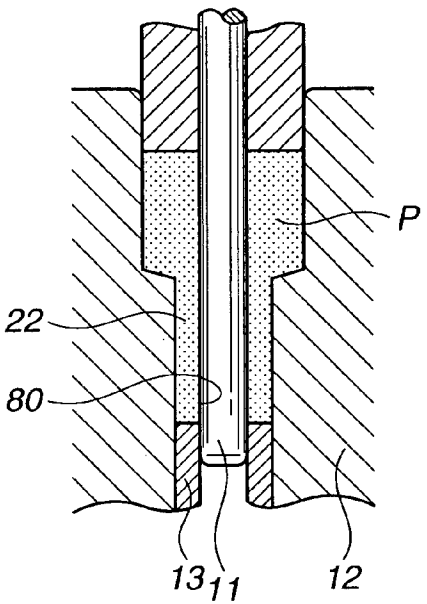
FIGS. 1A to 1D are fragmentary sectional views showing process steps of making an intermediate article of a metallic shell according to an embodiment of the present invention.

DESCRIPTION OF THE PREFERRED EMBODIMENTS (Structure of Spark Plug)

Referring to FIG. 3, a spark plug is generally indicated by 1 and includes a tubular metallic shell 2 having a concentric, multi-stepped through hole 8, a tubular insulator 3 disposed in the through hole 8 having a concentric through hole 3H, a center electrode 4 disposed in a tip end side portion of the through hole 3H and a ground electrode 5 having one end fixedly attached to a tip end face of the metallic shell 2 and the other end side disposed opposite to the tip end face of the center electrode 4. The metallic shell 2 is tubular and has an intermediate tubular portion 21 having an outer circumferential periphery protruded radially outward, a tip end side tubular portion 22 smaller in outer diameter than the intermediate tubular portion 21 and disposed on the tip end side of the intermediate tubular portion 21 and a base end side tubular portion 23 disposed on the base end side of the intermediate tubular portion 21. In the meantime, the tip end side tubular portion 22 has on the outer circumferential surface thereof a male thread 6 by means of which the spark plug 1 is screwed onto a cylinder head (not shown), etc. and at the tip end side outer peripheral edge a chamfered or beveled portion 6X. The base end side tubular portion 23 has a tool engagement section 231 which is engaged by a tool such as a wrench at the time of installation of the spark plug 1 to the cylinder head or the like. The base end side tubular portion 23 further has at a base end side of the tool engagement section 231 a caulking section 232 used for fixing the insulator 3 to the metallic shell 2 by caulking. Further, the multi-stepped through hole 8 has, in order from the base end side to the tip end side, a large diameter hole section 8L, an intermediate diameter hole section 8M smaller in diameter than the large diameter hole section 8L and a small diameter hole section 8S smaller in diameter than the intermediate diameter hole section 8M that are arranged successively. In the meantime, in FIG. 3, indicated by 40 is a gasket fitted on the tip end side tubular portion 22 so as to be located on a base end side thereof. Further, the metallic shell 2 is shaped so that the length L from the end face of the intermediate tubular portion 21 to the tip end face of the tip end side tubular portion 22 is 25 mm and the outer diameter D of the tip end side tubular portion 22 is 10.1 mm.

On the other hand, the insulator 3 is made of alumina ceramic and has the through hole 3H extending axially thereof. Also, within the through hole 3H and at the tip end side thereof is disposed the center electrode 4. Within the through hole 3H and at the base end side thereof is fixed a terminal member 7 for applying a high voltage to the center electrode 4. Further, within the through hole 3H and between the center electrode 4 and the terminal member 7 is disposed a resistor 9. The resistor 9 is electrically connected at the opposite ends thereof to center electrode 4 and the terminal member 7 by way of electrically conductive glass seal layers 10. Also by the electrically conductive glass seal layers 10, the center electrode 4, resistor 9 and the terminal member 7 are hermetically sealed with respect to the through hole 3H. Further, the insulator 3 includes a protruded portion 31 that protrudes radially outward so as to fittingly engage the large diameter hole section 8L when the insulator 3 is fitted in the metallic shell 2, a base end portion 32 located on the base end side of the protruded portion 31 and smaller in outer diameter than the large diameter hole section 8L of the metallic shell 2, an intermediate portion 33 disposed on the tip end side of the protruded portion 31 and engaging the intermediate diameter hole section 8M when the insulator 3 is fitted in the metallic shell 2, and a tip end portion or leg portion 34 that forms a space within the small diameter hole section 8S when the insulator 3 is fitted in the metallic shell 2.

(Method of Making Metallic Shell)

Referring to FIGS. 1A to 1D, a method of making the metallic shell 2 will be described.

Figure 3A:
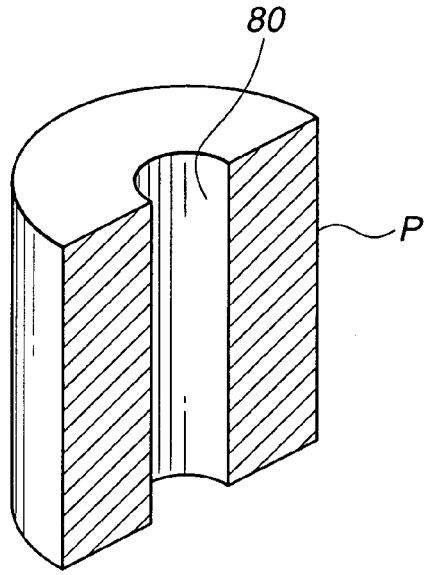
FIG. 3A is a sectional, perspective view of a pipe-shaped blank.

Firstly, a pipe that is used as a starting material for a method of making a metallic shell is cut to a predetermined length thereby preparing a pipe-shaped blank P shown in FIG. 3A. The blank P is made of a low carbon steel such as S10C, S17C, S25C, S45C, SVS430 that are prescribed in Japanese Industrial standards and has a concentric through hole 80 that is equal in diameter to the small diameter hole section 8S of the multi-stepped through hole 8. The outer diameter of the blank P is equal to that of the intermediate tubular portion 21 of the metallic shell 2. In the meantime, while it is most effective to form the blank P by utilizing a pipe that has the inner and outer diameters described as above, the inner and outer diameters of the blank P may be adjusted to size by pre-treatments that are carried out prior to subjecting the blank P to a deformation process.

Then, as shown in FIG. 1A, the blank P is loaded in a forging die of a cold forging machine and the tip end side tubular portion 22 is formed by extrusion or cold forging. Namely, a pin 11 of such a thickness as to fit in the through hole 80 is first inserted into the hole 80. Then, the blank P is inserted into a die 12 together with the pin 11 and pushed down by a punch (no numeral) such that the tip end side tubular portion 22 is formed by extrusion. In this instance, the leading end portion of the pin 11 is adapted to move into a kick-out sleeve 13 (which may be integral with the die 12) to be supported thereby. Further, an upper portion of the blank P above the tip end side tubular portion 22 maintains an initial outer diameter, i.e., an outer diameter equal to that of the intermediate tubular portion 21.

Figure 1B:
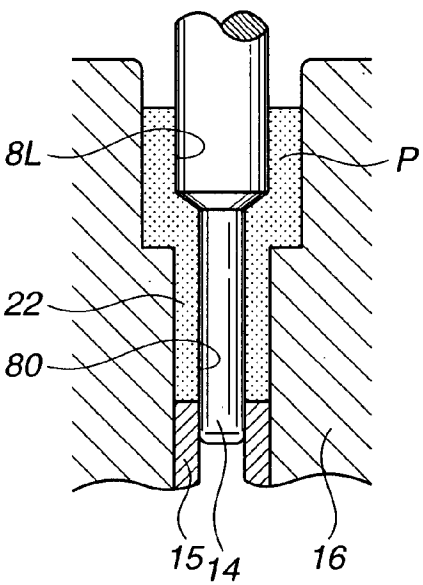

Then, as shown in FIG. 1B, a punch 14 with a pin equal in diameter to the pin 11 is inserted into the through hole 80 of the blank P and pushed down such that the upper part of the through hole 80 is expanded to form the large diameter hole section 8L of the stepped hole 8 by extrusion or cold forging. In this instance, the leading end portion of the punch 14 is adapted to move into a kick-out sleeve 15 (the kick-out sleeve 15 may be formed integral with a die 16) to be supported thereby. In the meantime, even at this stage of forming, the portion of the blank P above the tip end side tubular portion 22 maintains an outer diameter equal to that of the intermediate tubular portion 21.

Figure 1C:
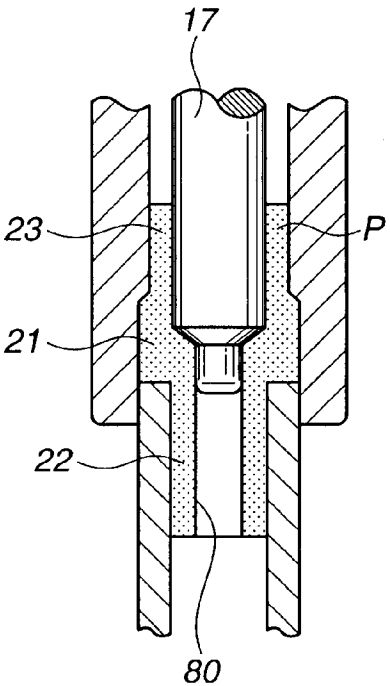
Figure 3B:
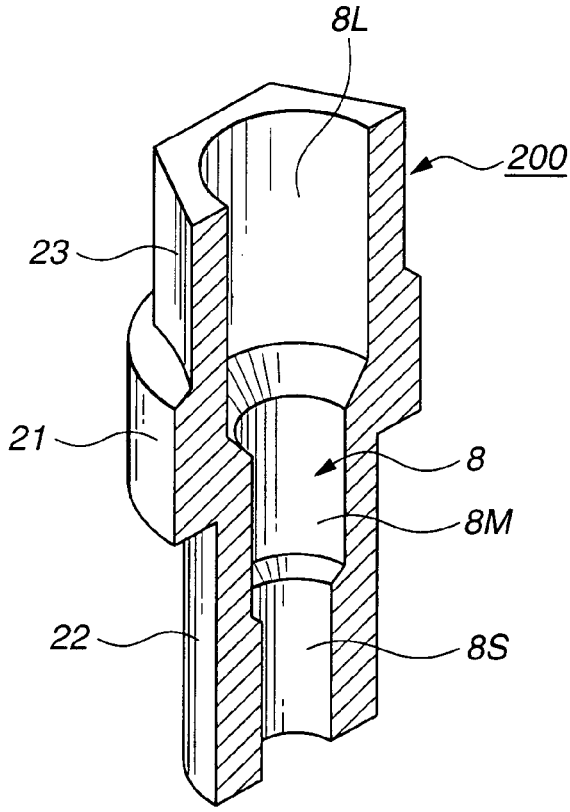
FIG. 3B is a sectional, perspective view of an intermediate article for a metallic shell.

Then, as shown in FIG. 1C, a mandrel 17 is inserted into an upper part of the through hole 80, while surrounding the upper part of the blank P above the tip end side tubular portion 22 by an upper die (no numeral) having a stepped hole including a larger diameter hole section equal in diameter to the outer circumferential periphery of the intermediate tubular portion 21 and a smaller diameter hole section equal in diameter to the outer circumferential periphery of the base end side tubular portion such that the base end side tubular portion 23 is formed by backward extrusion or cold forging. The base end side tubular portion 23 in this embodiment has a hexagonal outer peripheral shape as shown in FIG. 3B. However, the outer peripheral shape of the base end side tubular portion 23 is not limited to the hexagonal shape but can be any other shape such as a so-called Bi-HEX shape.

In the meantime, by the process steps described above, i.e., the process steps shown in FIGS. 1A to 1C, the tip end side tubular portion 22 and the base end side tubular portion 23 have been formed. This causes the intermediate tubular portion 21 between the tip end side tubular portion 22 and the base end side tubular portion 23 to be formed naturally.

Figure 1D:
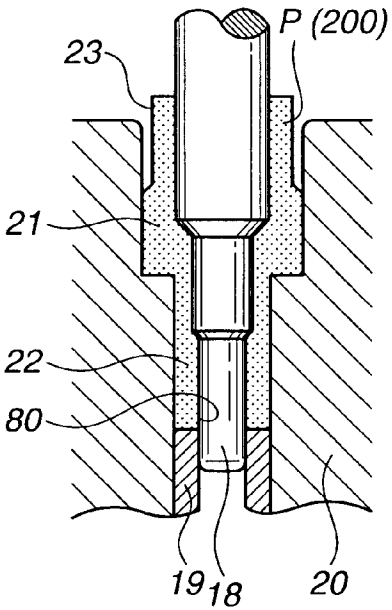
Figure 2A:
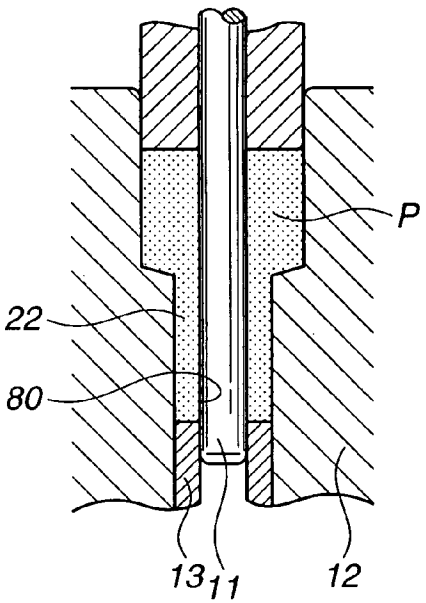
FIGS. 2A to 2D are views similar to FIGS. 1A to 1D but show process steps according to a modification of the present invention.
Figure 2B:
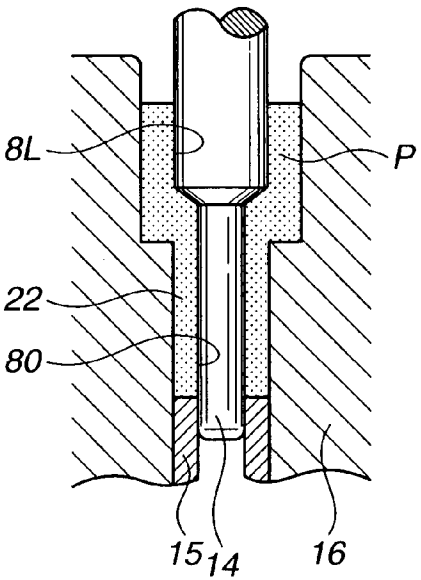
Figure 2C:
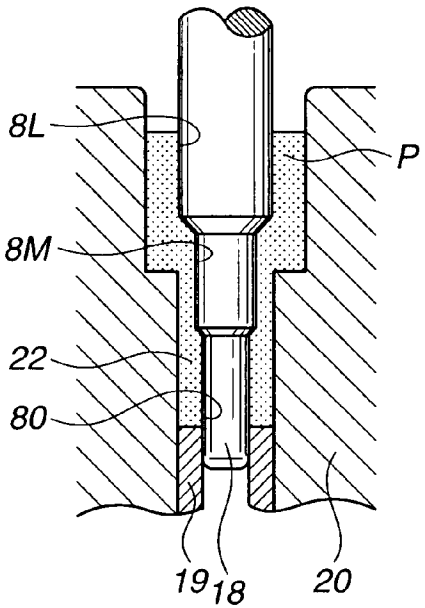
Figure 2D:
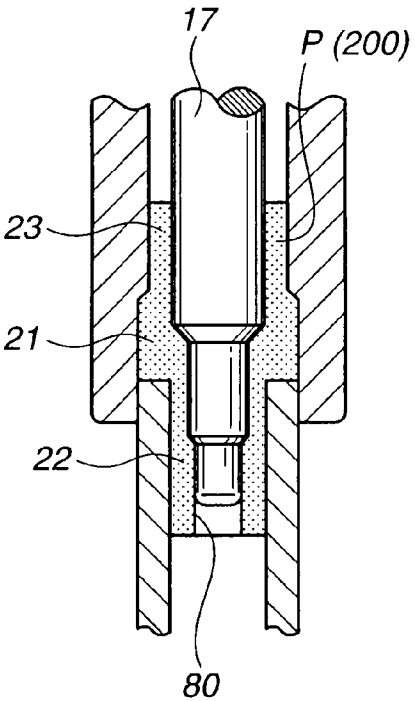

Then, as shown in FIG. 1D, the blank P having been processed as above is loaded in a die 20 and a stepped punch 18 is pushed into the axial through hole 80 so that the intermediate diameter hole section 8M of the stepped hole 8 is formed by extrusion or cold forging. In this instance, the punch 18 is multi-stepped to have a small diameter portion, intermediate diameter portion and larger diameter portion that are equal in diameter to the small diameter hole section 8S, intermediate diameter hole section 8M and large diameter hole section L, respectively. The small diameter portion of the punch 18 is adapted to move into a kick-out sleeve 19 (which may be integral with a die 20) to be supported thereby. The die 20 has a through hole (no numeral) with a smaller diameter hole section of the diameter equal to the outer diameter of the tip end side tubular portion 22 and a larger diameter hole section of a diameter equal to the outer diameter of the intermediate tubular portion 21. By the process steps described above, the large diameter hole section 8L and the intermediate diameter hole section 8M have been formed. This causes the small diameter hole section 8L to be formed naturally.

In the meantime, in the method having the steps of FIGS. 1A to 1D, the order of the steps can be changed, i.e., the step of FIG. 1C and the step of FIG. 1D can be replaced with each other. The steps of such a method are shown in FIGS. 2A to 2D and the description thereto is omitted for brevity since it will be the same as that of the steps of FIGS. 1A to 1D except for replacement of the description of FIG. 1C with that of FIG. 1D.

By the steps of FIGS. 1A to 1D or 2A to 2D, a metallic shell intermediate article 200 shown in FIG. 3B is obtained. The metallic shell intermediate article 200 is formed at the tip end side tubular portion 22 with the male thread 6 (refer to FIG. 4) and the chamfered or beveled portion 6X. The base end of the base end side tubular portion 23 is cut or machined so as to be formed with a caulking section 232. Further, the tool engagement section 231 is finished by suitable cutting or machining, whereby the metallic shell 2 is completed. In the meantime, there is no limitation in the means or steps employed for machining or forming the male thread 6 at the tip end side tubular portion 22, the caulking section 232 at the base end side tubular portion 23 and the groove 233 at the base end side tubular portion 23.

Figure 4:
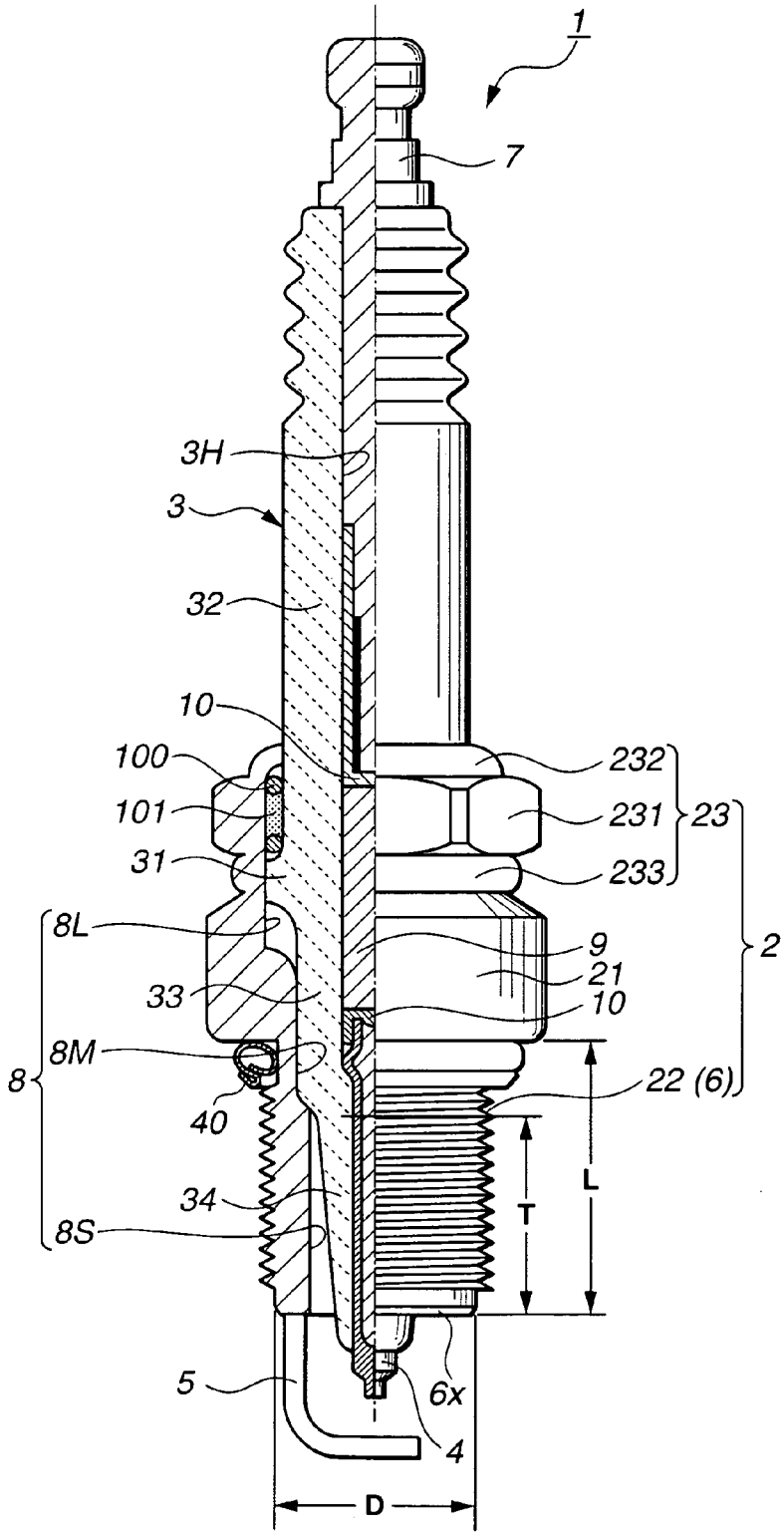
FIG. 4 is an elevational, half-sectional view of a spark plug.

Then, in the multi-stepped hole 8 of the metallic shell 2 made by cold forging and machining as described above is fitted the insulator 3 receiving therewithin the center electrode 4 as shown in FIG. 4, and the caulking section 232 is bent inward, i.e., caulked. This causes the protruded portion 31 of the insulator 3 to be lockingly engaged with the caulking section 232 of the metallic shell 2 by way of rings 100 and ceramic filler powder 101, while causing a shoulder section between the intermediate diameter hole section 8M and the small diameter hole section 8S and a shoulder section between the intermediate portion 33 and the leg portion 34 to be abuttingly engaged with each other. In this manner, the insulator 3, etc. are installed in the metallic shell 2, whereby the assemblage of the spark plug 3 is completed.

From the foregoing, it will be understood that according to an aspect of the present invention, a metal pipe is used as a starting material in the method of making a metallic shell, that is, a pipe is used for preparing a pipe-shaped blank P. This can dispense with piercing or perforating of the through hole 80 of the blank P and therefore the tools such as a punch and die for such piercing or perforating. Further, the method described above makes it possible to form the multi-stepped hole straightly, in a way as to allow the multi-stepped hole to have a good straightness, thus making it possible to produce a spark plug of a small sized and long reach type with a high accuracy and at low cost.

It will be further understood that according to another aspect of the present invention the inner diameter of a pipe that is used as a starting material is larger than the small diameter hole section 8S and smaller than the large diameter hole section 8L of the multi-stepped hole 8. By this aspect, an amount of metal to be processed (i.e., an amount of metal that is caused to flow for forming the multi-stepped hole 8) can be smaller. This makes it possible to elongate the life of the tools or dies while making it possible to produce the metallic shell 2 with a high accuracy and at low cost. The inner diameter of the pipe is preferably made equal to one of the large diameter hole section 8L, intermediate diameter hole section 8M and small diameter hole section 8S of the multi-stepped hole 8. When this is the case, it becomes possible to dispense with processing of a hole section with a diameter to which the inner diameter of the pipe is made equal, thus making it possible to further elongate the life of the tools used in the method and produce the metallic shell 2 with a higher accuracy and at lower cost. In the meantime, "making the inner diameter of the pipe be equal to one of the large diameter hole section 8L, intermediate diameter hole section 8M and small diameter hole section 8S of the multi-stepped hole 8" is herein intended to indicate that the inner diameter of the metal pipe is preferably made equal to the standard diameter size of one of the hole sections 8L, 8M, 8S but it will suffice to make the inner diameter of the pipe be within a tolerance of the diameter of one of the hole sections.

It will be further understood that according to a further aspect of the present invention the inner diameter of the pipe is equal to the diameter of the small diameter hole section 8S. This can dispense with processing of the small diameter hole section 8S, thus making it possible to elongate the life of the tools used in carrying out the method and produce the metallic shell at low cost.

It will be further understood that according to a further aspect of the present invention the outer diameter of the pipe that is used as a starting material is larger than that of the tip end side tubular portion 22 of the metallic shell 2 and smaller than the intermediate tubular portion 21 of the metallic shell 2. When this is the case, the amount of metal to be processed (i.e., an amount of metal caused to flow for forming the tip end side tubular portion 22, intermediate tubular portion 21 and base end side tubular portion 23) can be smaller, thus making it possible to elongate the life of the tools or dies used for carrying out the method and produce the metallic shell 2 with a high accuracy and at low cost. Further, it is preferable to make the outer diameter of the pipe that is used as a starting material be equal to that of one of the tip end side tubular portion 22, intermediate tubular portion 21 and base end side tubular portion 23. This can dispense with processing of the tubular portion of an outer diameter to which the outer diameter of the pipe is made equal, thus making it possible to further elongate the life of the tools used in the method and produce the metallic shell 2 with a higher accuracy and at lower cost. In the meantime, "making the outer diameter of the pipe be equal to that of one of the tip end side tubular portion 22, intermediate tubular portion 21 and base end side tubular portion 23 is intended to indicate that the outer diameter of the pipe is preferably made equal to the standard diameter size of one of the tubular portions but it will suffice to make the outer diameter of the pipe be within the tolerance of the outer diameter of one of the tubular portions.

It will be further understood that the method of the present invention makes it possible to produce a metallic shell with a straight multi-stepped hole assuredly even if the final shape of the metallic shell is of such dimensions that a length L from an end face of the intermediate tubular portion to a tip end face of the tip end side tubular portion exceeds 19 mm (i.e., of so-called long reach type). This makes it possible to elongate the life of the tools used in the method.

It will be further understood that the method of the present invention makes it possible to produce a metallic shell with a straight multi-stepped hole assuredly even if the final shape of the metallic shell is of such dimensions that the front end diameter D of the tip end side tubular portion is less than 10.5 mm. This makes it possible to elongate the life of the tools used in the method. In the meantime, the front end diameter D is intended to indicate the diameter of the front end of the metallic shell excluding the chamfered corner portion. Accordingly, the present invention is applicable to a spark plug of the type that does not have any thread on the outer peripheral surface thereof, i.e., of a so-called unthreaded type.

It will be further understood that the method of the present invention makes it possible to produce a metallic shell with ease even if the final shape of the metallic shell is of such dimensions that an axial length T of the small diameter hole section exceeds 2 mm, the metallic shell of such dimensions having a difficulty of being produced.

It will be further understood that according to a further aspect of the present invention the metallic shell 2 of the spark plug 1 is formed from the pipe-shaped blank P that is prepared by using the metal pipe having a predetermined inner diameter that is made equal to that of the small diameter hole section 8S (i.e., the smallest diameter hole section). That is, the small diameter hole section 8S of the metallic shell 2 can be obtained by utilizing the inner diameter of the pipe as it is, thus making it possible to dispense with processing of the small diameter hole section 8S and therefore making it possible to obtain the spark plug 1 that is highly accurate and produced at low cost. Further, the hole sections of the metallic shell 2 other than the small diameter hole section 8S is formed by enlarging the inner diameter of the pipe. This enables the multi-stepped hole 8 of the metallic shell 2 to be formed by utilizing the axis of the pipe, thus making it possible to obtain the spark plug 1 with the metallic shell 2 having the multi-stepped hole 8 of a good straightness.

The entire contents of Japanese Patent Applications P2003-12763 (filed Jan. 21, 2003) are incorporated herein by reference.

Figure 5:
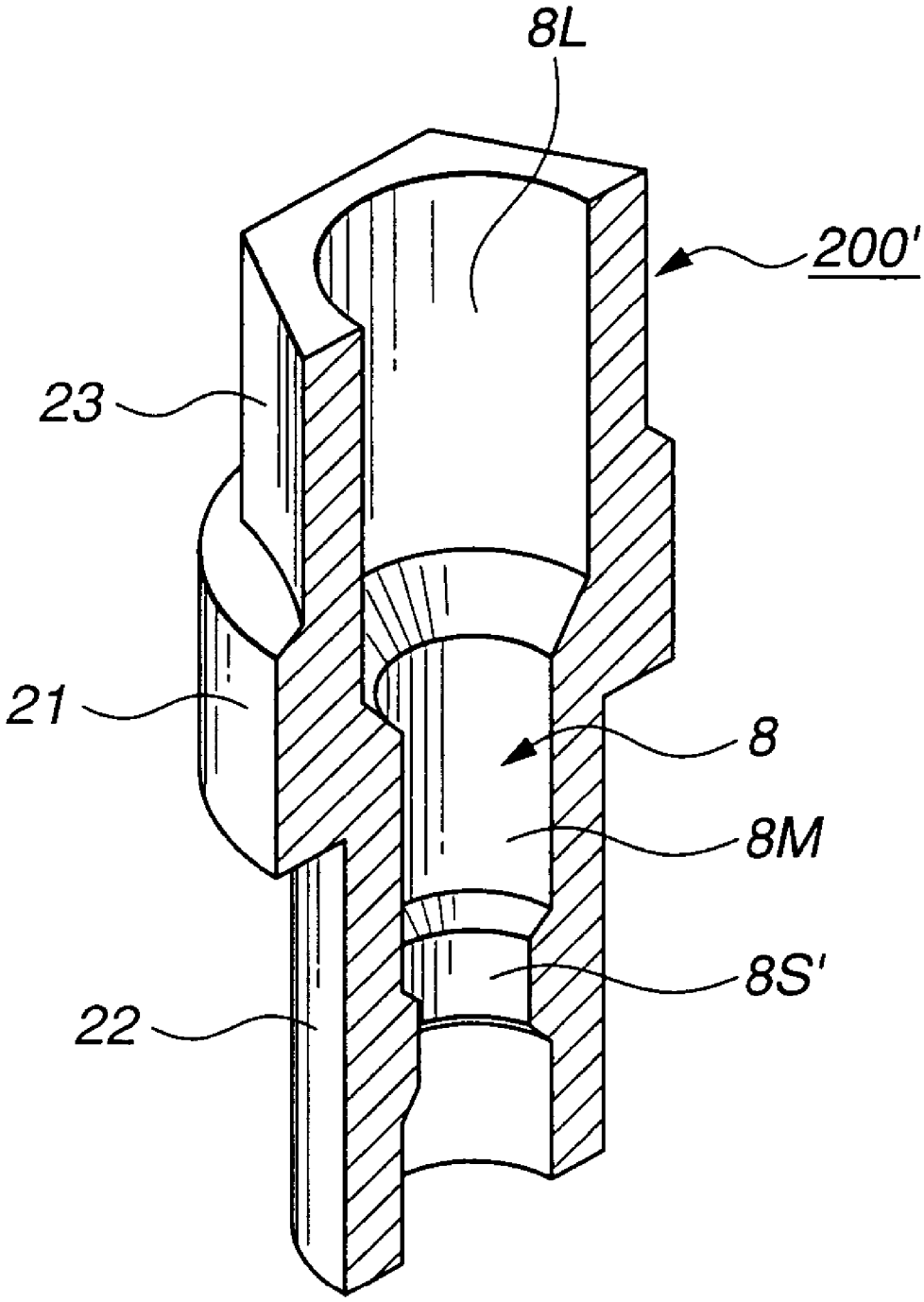
FIG. 5 is a sectional, perspective view of an intermediate article for a metallic shell according to another embodiment of the present invention.

Although the invention has been described above by reference to certain embodiments of the invention, the invention is not limited to the embodiments described above. Modifications and variations of the embodiments described above will occur to those skilled in the art, in light of the above teachings. For example, as shown in FIG. 5, the lower half of the small diameter hole section 8S' of the multi-stepped hole 8 of the intermediate article 200' may be expanded so as to be nearly equal in diameter to the intermediate diameter hole section 8M. When such is the case, a cold forging step for forming such an expanded hole section by a punch that is inserted into the hole 80 from the lower side thereof is added to the middle or the end of the steps of FIGS. 1A to 1D or FIGS. 2A to 2D. Further, while cold forging is employed for forming the metallic shell 8 in the embodiments described as above, this is not for the purpose of limitation but other deformation processes such as a press forming process by means of a known press machine may be employed. Further, while the metallic shell 2 that can be made by the method of the present invention can be varied in size variously but the method of the present invention can exert most usefulness in case the final shape of the metallic shell 2, as in the embodiment described above, is of such dimensions that the length L (refer to FIG. 4) from the end face of the intermediate tubular portion 21 to the tip end face of the tip end side tubular portion 22 exceeds 19 mm or the tip end diameter D (refer to FIG. 4) of the tip end side tubular portion 22 is less than 10.5 mm or the axial length T (refer to FIG. 4) of small diameter hole section 8S exceeds 2 mm. The spark plug 1 for which the metallic shell 2 of the size and shape described above is classified into a small-sized or long reach type. By the conventional method using a solid metal bar as a starting material, there is a difficulty in attaining a desired concentricity of a multi-stepped hole or the life of the tools such as dies and punches used in the deformation process is short, leading to a difficulty in mass-producing the metallic shell with a stable quality. The scope of the invention is defined with reference to the following claims.

What is claimed is:

1. A method of making a metallic shell for a spark plug, the metallic shell including a multi-stepped through hole, an intermediate tubular portion, a tip end side tubular portion disposed on a tip end side of the intermediate tubular portion and a base end side tubular portion disposed on a base end side of the intermediate tubular portion, the through hole including, in the order from a base end side to a tip end side of the spark plug, a large diameter hole section, an intermediate diameter hole section smaller in diameter than the large diameter hole section and a small diameter hole section smaller in diameter than the intermediate diameter hole section, the method comprising the steps of;

cutting a metal pipe that is used as a starting material to a predetermined length and thereby preparing a pipe-shaped blank; and subjecting the blank to a deformation process comprising extrusion and thereby forming the blank into the metallic shell, wherein an outer diameter of the pipe is larger than that of the tip end side tubular portion of the metallic shell and equal to or smaller than that of the intermediate tubular portion.

2. A method according to claim 1, wherein an inner diameter of the pipe is larger than a diameter of the small diameter hole section and smaller than a diameter of the large diameter hole section.

3. A method according to claim 1 wherein an inner diameter of the pipe is equal to a diameter of the small diameter hole section.

4. A method according to claim 1, further comprising:

after the step of cutting, a second step of forming by extrusion a tip end side portion of the blank into the tip end side tubular portion smaller in outer diameter than the blank;

a third step of processing a base end side of the blank by extrusion to partially expand a through hole of the blank and thereby forming the large diameter hole section;

a fourth step of processing the base end side of the blank by extrusion and thereby forming the base end side tubular portion that is smaller in outer diameter than the blank while at the same time forming the intermediate tubular portion; and a fifth step of processing the base end side of the blank by extrusion to partially expand the through hole of the blank and thereby forming the intermediate diameter hole section while at the same time forming the small diameter hole section.

5. A method according to claim 1, further comprising:

after the step of cutting, a second step of forming by extrusion a tip end side portion of the blank into the tip end side tubular portion smaller in outer diameter than the blank;

a third step of processing a base end side of the blank by extrusion to partially expand a through hole of the blank and thereby forming the large diameter hole section;

a fourth step of processing the base end side of the blank by extrusion to partially expand the through hole of the blank and thereby forming the intermediate diameter hole section while at the same time forming the small diameter hole section; and a fifth step of processing the base end side of the blank by extrusion and thereby forming the base end side of the blank into the base end side tubular portion smaller in outer diameter than the blank while at the same time forming the intermediate tubular portion.

6. A method according to claim 1, wherein a final shape of the metallic shell is of such dimensions that a length L from an end face of the intermediate tubular portion to a tip end face of the tip end side tubular portion exceeds 19 mm.

7. A method according to claim 1, wherein the final shape of the metallic shell is of such dimensions that a tip end diameter D of the tip end side tubular portion is less than 10.5 mm.

8. A method according to claim 1, wherein a final shape of the metallic shell is sized so that an axial length T of the small diameter hole section exceeds 2 mm.

* * * * *